US008042203B2

(12) United States Patent
Lin

(10) Patent No.: US 8,042,203 B2
(45) Date of Patent: Oct. 25, 2011

(54) FAUCET BODY

(75) Inventor: Wen-Tsung Lin, Fangyuan Township, Changhua County (TW)

(73) Assignee: Hsue Sam Enterprise Co., Ltd., Changhua County (TW)

( * ) Notice: Subject to any disclaimer, the term of this patent is extended or adjusted under 35 U.S.C. 154(b) by 1099 days.

(21) Appl. No.: 11/842,545

(22) Filed: Aug. 21, 2007

(65) Prior Publication Data

US 2008/0120773 A1 May 29, 2008

(30) Foreign Application Priority Data

Nov. 23, 2006 (TW) ..... 95220655 U

(51) Int. Cl.
*E03C 1/04* (2006.01)

(52) U.S. Cl. ..... 4/678

(58) Field of Classification Search ..... 4/675, 678, 4/695, 624, 626, 671–673, 619, 191–192; 251/218; 29/157; 137/315, 359, 15.01, 801
See application file for complete search history.

(56) References Cited

U.S. PATENT DOCUMENTS 4,762,143 A * 8/1988 Botnick ..... 137/15.01
5,746,244 A * 5/1998 Woolley et al. ..... 137/359
7,766,043 B2 * 8/2010 Thomas et al. ..... 137/801

* cited by examiner

*Primary Examiner* — Lori Baker
(74) *Attorney, Agent, or Firm* — Alan Kamrath; Kamrath & Associates PA

(57) ABSTRACT

A faucet body includes an inner pipe and an outer pipe enclosed around the inner pipe. The inner pipe is formed by a plastic injection molding process and has an inside formed with a water guide channel. Preferably, the outer pipe is directly enclosed around the outside of the inner pipe after the inner pipe is formed and is formed by a plastic injection molding process so that the inner pipe and the outer pipe are combined together. Thus, the outer pipe is enclosed around the inner pipe to form the faucet body, and the outer pipe and the inner pipe are formed by a plastic injection molding process, so that the faucet body is made and worked easily and quickly.

11 Claims, 5 Drawing Sheets

FAUCET BODY

BACKGROUND OF THE INVENTION

1. Field of the Invention

The present invention relates to a faucet body and, more particularly, to a faucet body for a faucet to switch a water flow for use with a user.

2. Description of the Related Art

A conventional faucet body for a faucet has an inside formed with a water guide channel and has a first end formed with a water inlet connected to the water guide channel and a second end formed with a water outlet connected to the water guide channel. The water inlet of the faucet body is connected to a water source, and the water outlet of the faucet body is connected to a spout which has a threaded mounting portion for mounting a filter and/or an aerator. The faucet body is made of metal and is worked by forging, pressing or casting so that the faucet body has a determined thickness to bear the water pressure and has a heat insulating effect.

However, the faucet body made of metal has a higher melting point so that the faucet body is not worked easily and quickly, thereby increasing the working time, and decreasing the working efficiency. In addition, the faucet body has an irregular surface after the working process, so that the faucet body needs to proceed a further treatment, such as polishing, electroplating and the like, so as to have a smooth surface, thereby simplifying the manufacturing procedures, and thereby increasing the costs of fabrication. Further, the spout of the faucet body needs to proceed a further treatment, such as threading, so as to form the threaded mounting portion for mounting the filter and/or the aerator, thereby simplifying the manufacturing procedures, and thereby increasing the costs of fabrication. Further, the faucet body made of metal has a greater wall thickness so that the threaded mounting portion of the spout of the faucet body is made into an inner thread and cannot be made into an outer thread, thereby increasing the difficulty of the working procedure, and increasing the costs of fabrication.

BRIEF SUMMARY OF THE INVENTION

In accordance with the present invention, there is provided a faucet body, comprising an inner pipe and an outer pipe enclosed around an outside of the inner pipe. The inner pipe is formed by a plastic injection molding process. The inner pipe has an inside formed with a water guide channel. The outer pipe has a first end formed with a water inlet connected to a first end of the water guide channel of the inner pipe and a second end formed with a water outlet connected to a second end of the water guide channel of the inner pipe. Preferably, the outer pipe is directly enclosed around the outside of the inner pipe after the inner pipe is formed by a plastic injection molding process so that the inner pipe and the outer pipe are combined together.

The primary objective of the present invention is to provide a faucet body that is worked easily and quickly.

Another objective of the present invention is to provide a faucet body, wherein the outer pipe is enclosed around the inner pipe to form the faucet body, and the outer pipe and the inner pipe are formed by a plastic injection molding process, so that the faucet body is made easily and quickly.

A further objective of the present invention is to provide a faucet body, wherein the inner pipe is directly formed with the water guide channel so that the faucet body is worked easily and quickly.

A further objective of the present invention is to provide a faucet body, wherein the faucet body is formed by a plastic injection molding process so that the faucet body is made and worked easily and quickly, thereby decreasing the costs of fabrication, and thereby enhancing the quality of production.

A further objective of the present invention is to provide a faucet body, wherein the faucet body is formed by a plastic injection molding process so that the shape of the faucet body can be changed arbitrarily, thereby enhancing the outer appearance of the faucet body.

A further objective of the present invention is to provide a faucet body, wherein the faucet body is formed by a plastic injection molding process so that the faucet body has a smooth outer surface without needing an additional working step, such as polishing, thereby simplifying the working procedure of the faucet body.

A further objective of the present invention is to provide a faucet body, wherein the faucet body consists of the outer pipe and the inner pipe so that the faucet body has a determined thickness, thereby enhancing the heat insulating effect and the structural strength of the faucet body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
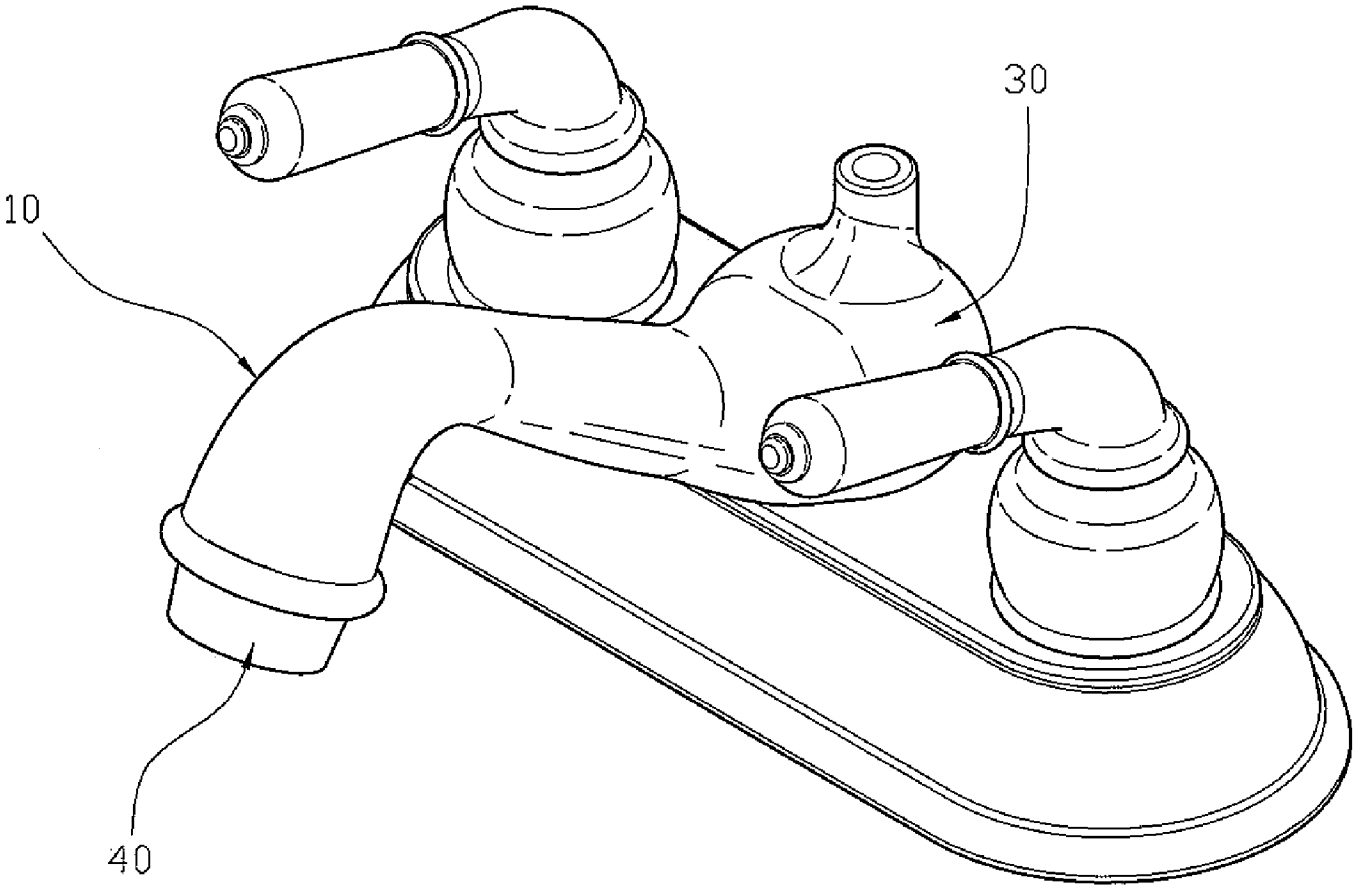
FIG. 1 is a perspective view of a faucet body in accordance with the preferred embodiment of the present invention.
Figure 2:
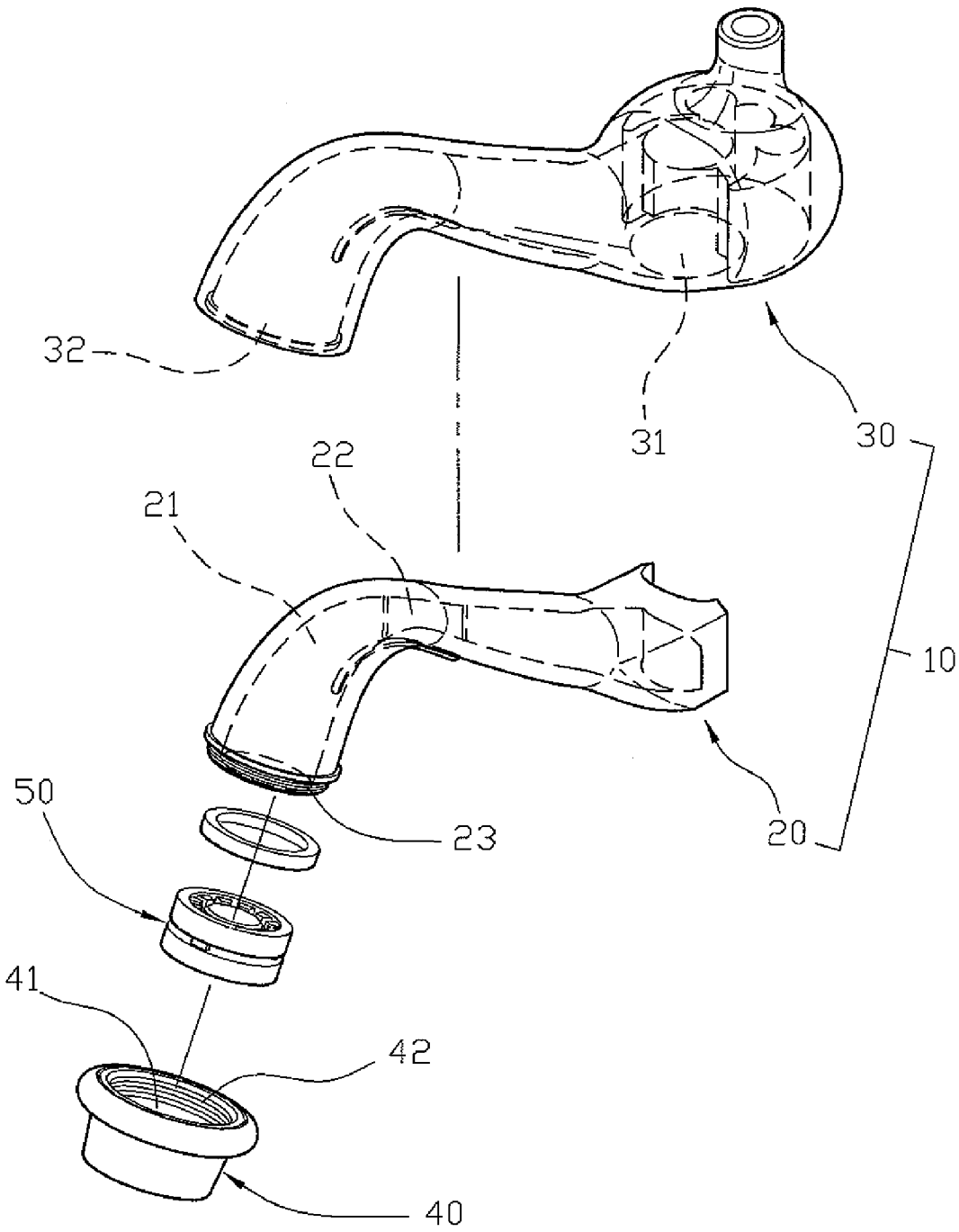
FIG. 2 is an exploded perspective view of the faucet body as shown in FIG. 1.
Figure 3:
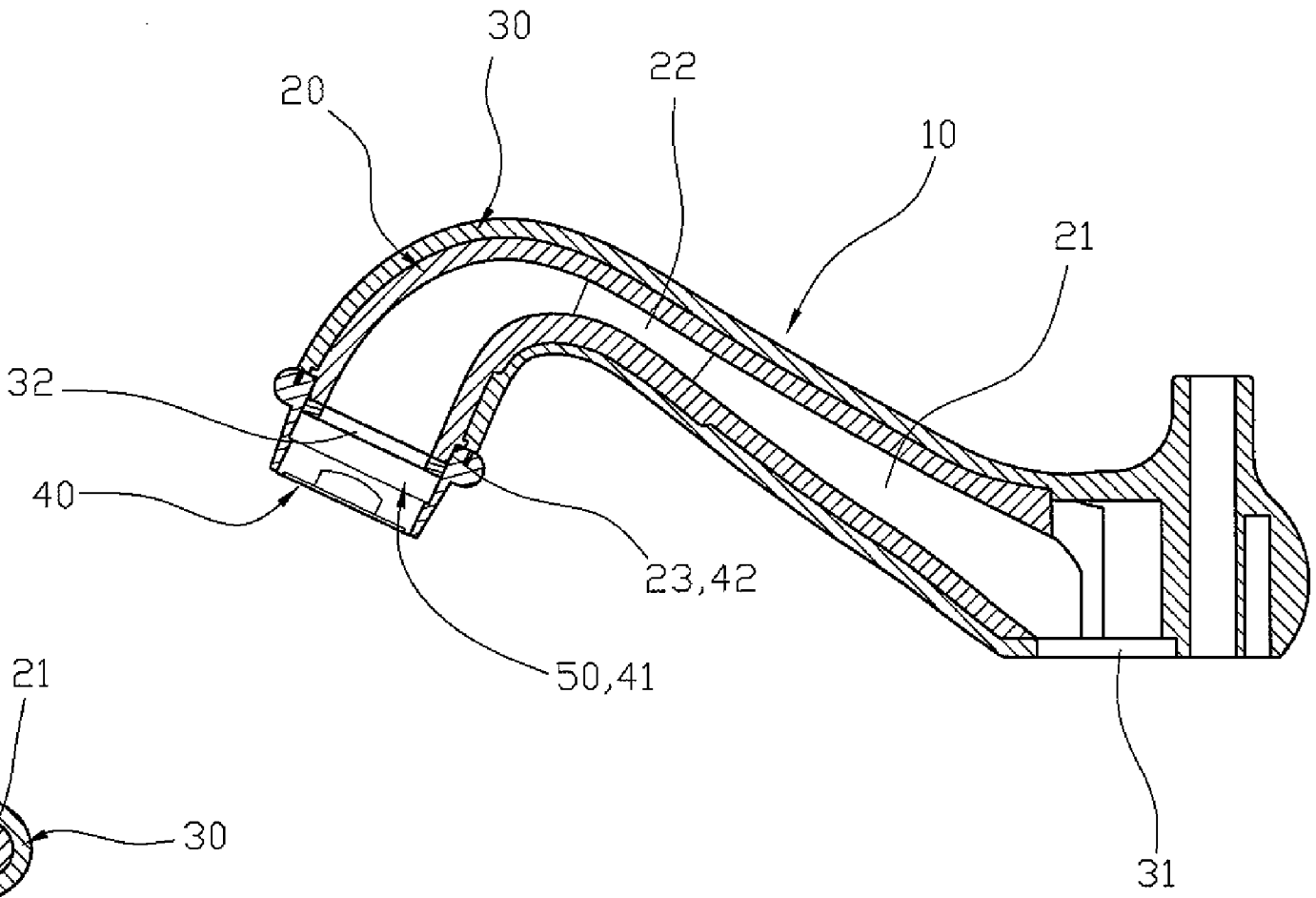
FIG. 3 is a side cross-sectional view of the faucet body as shown in FIG. 1.
Figure 5:
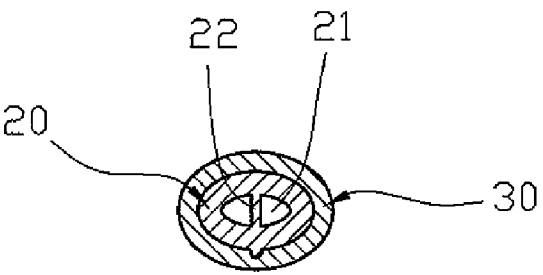
FIG. 5 is a partially front cross-sectional view of the faucet body as shown in FIG. 1.
Figure 4:
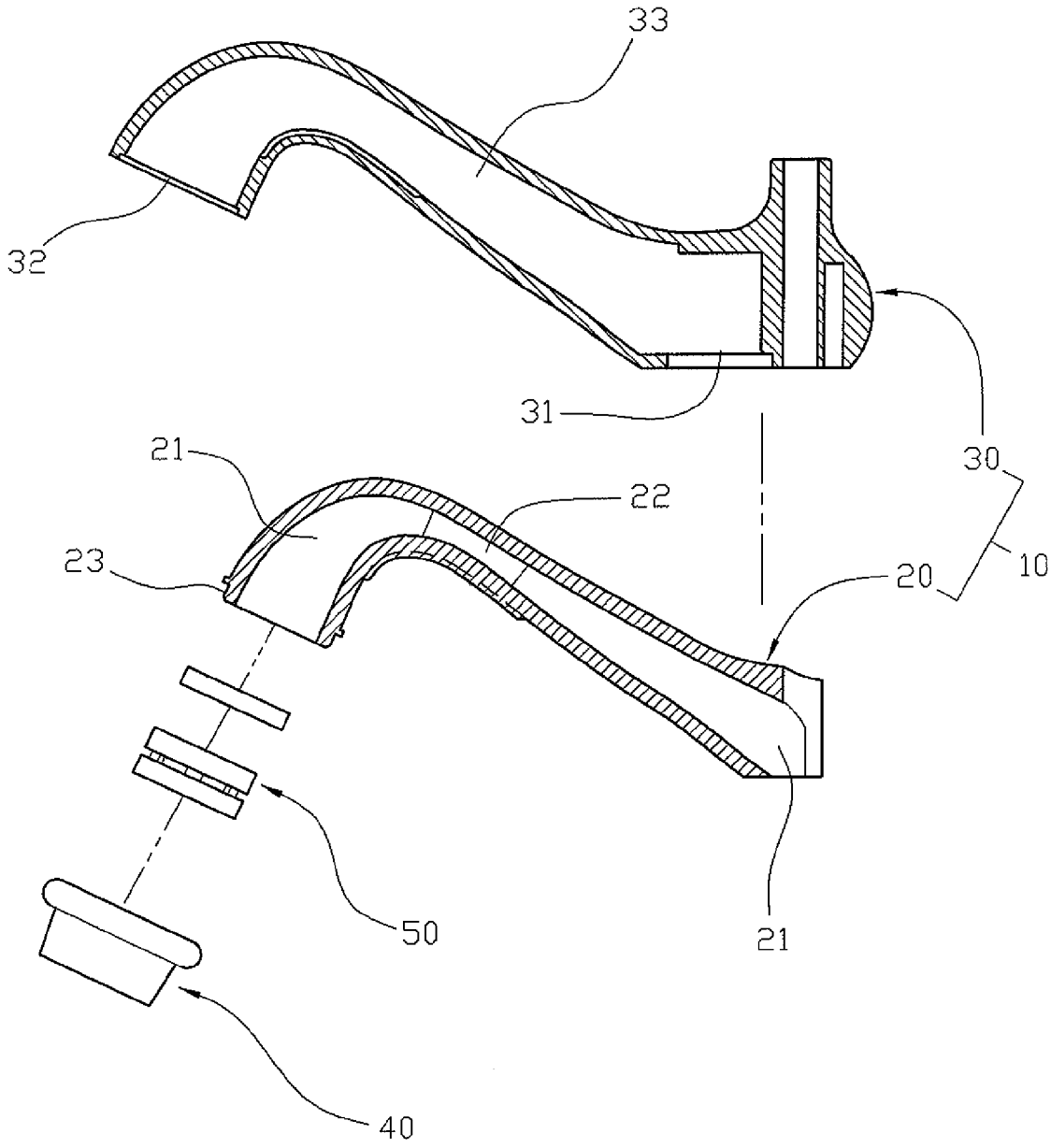
FIG. 4 is an exploded cross-sectional view of the faucet body as shown in FIG. 3.
Figure 6:
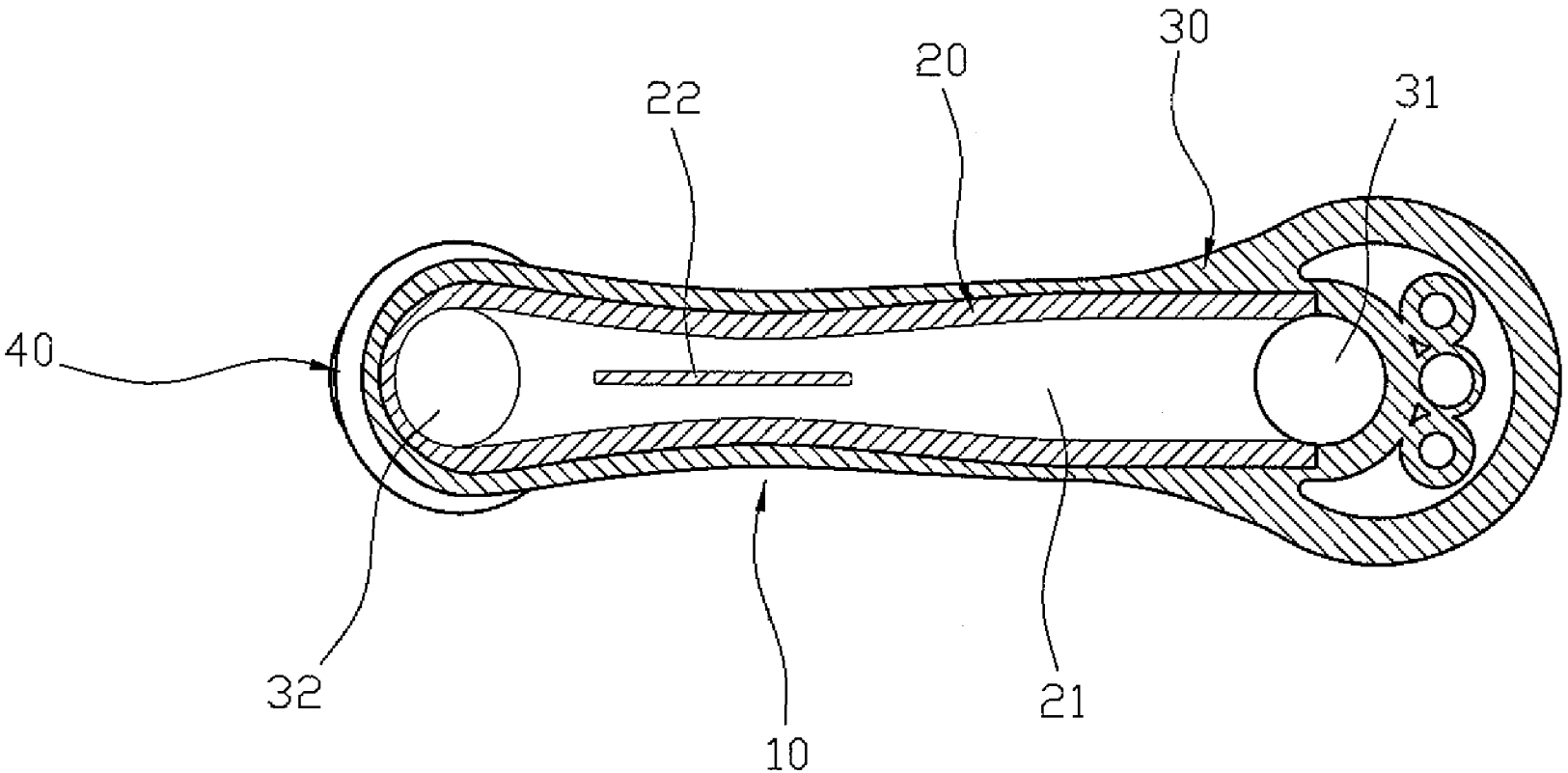
FIG. 6 is a bottom cross-sectional view of the faucet body as shown in FIG. 1.

Referring to FIGS. 1-6, a faucet body 10 for a faucet in accordance with the preferred embodiment of the present invention comprises an inner pipe 20 and an outer pipe 30 enclosed around an outside of the inner pipe 20.

The inner pipe 20 is formed by a plastic injection molding process. The inner pipe 20 has an inside formed with a water guide channel 21 which extends longitudinally through a whole length of the inner pipe 20. The inner pipe 20 is fully hidden and encompassed by the outer pipe 30. The inside of the inner pipe 20 is formed with a reinforcing rib 22 located in the water guide channel 21. The reinforcing rib 22 of the inner pipe 20 extends longitudinally in the water guide channel 21 and has a length smaller than that of the water guide channel 21.

The outer pipe 30 has a hollow inside 33 enclosed around the outside of the inner pipe 20. The outer pipe 30 has a first end formed with a water inlet 31 connected to a first end of the water guide channel 21 of the inner pipe 20 and a second end formed with a water outlet 32 connected to a second end of the water guide channel 21 of the inner pipe 20. The outer pipe 30 is directly enclosed around the outside of the inner pipe 20 after the inner pipe 20 is formed by a plastic injection molding process so that the inner pipe 20 and the outer pipe 30 are combined together.

The inner pipe 20 has an end portion formed with a threaded locking portion 23 which is located at the first end of the water guide channel 21 of the inner pipe 20 and protruded outwardly from the water outlet 32 of the outer pipe 30. Preferably, the threaded locking portion 23 of the inner pipe 20 is an outer threaded portion.

The faucet body 10 further comprises a locking sleeve 40 mounted on the inner pipe 20 and having an end portion formed with a threaded locking section 42 threadedly locked onto the threaded locking portion 23 of the inner pipe 20, and a filter 50 located between the locking sleeve 40 and the inner pipe 20. The locking sleeve 40 has an inside formed with a receiving space 41 to receive the filter 50. Preferably, the threaded locking section 42 of the locking sleeve 40 is an inner threaded portion screwed onto the outer threaded portion of the threaded locking portion 23 of the inner pipe 20.

Accordingly, the outer pipe 30 is enclosed around the inner pipe 20 to form the faucet body 10, and the outer pipe 30 and the inner pipe 20 are formed by a plastic injection molding process, so that the faucet body 10 is made easily and quickly. In addition, the inner pipe 20 is directly formed with the water guide channel 21 so that the faucet body 10 is worked easily and quickly. Further, the faucet body 10 is formed by a plastic injection molding process so that the faucet body 10 is made and worked easily and quickly, thereby decreasing the costs of fabrication, and thereby enhancing the quality of production. Further, the faucet body 10 is formed by a plastic injection molding process so that the shape of the faucet body 10 can be changed arbitrarily, thereby enhancing the outer appearance of the faucet body 10. Further, the faucet body 10 is formed by a plastic injection molding process so that the faucet body 10 has a smooth outer surface without needing an additional working step, such as polishing, thereby simplifying the working procedure of the faucet body 10. Further, the faucet body 10 consists of the outer pipe 30 and the inner pipe 20 so that the faucet body 10 has a determined thickness, thereby enhancing the heat insulating effect and the structural strength of the faucet body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A faucet body, comprising:

an inner pipe;

an outer pipe enclosed around an outside of the inner pipe; wherein the inner pipe is formed by a plastic injection molding process;

the inner pipe has an inside formed with a water guide channel;

the outer pipe has a first end formed with a water inlet connected to a first end of the water guide channel of the inner pipe and a second end formed with a water outlet connected to a second end of the water guide channel of the inner pipe;

wherein the inside of the inner pipe is formed with a reinforcing rib located in the water guide channel.

2. The faucet body in accordance with claim 1, wherein the outer pipe is directly enclosed around the outside of the inner pipe after the inner pipe is formed by a plastic injection molding process so that the inner pipe and the outer pipe are combined together.

3. The faucet body in accordance with claim 1, wherein the reinforcing rib of the inner pipe extends longitudinally in the water guide channel.

4. The faucet body in accordance with claim 1, wherein the reinforcing rib of the inner pipe has a length smaller than that of the water guide channel.

5. The faucet body in accordance with claim 1, wherein the inner pipe has an end portion formed with a threaded locking portion which is located at the first end of the water guide channel of the inner pipe and protruded outwardly from the water outlet of the outer pipe;

the faucet body further comprises a locking sleeve mounted on the inner pipe and having an end portion formed with a threaded locking section threadedly locked onto the threaded locking portion of the inner pipe.

6. The faucet body in accordance with claim 5, further comprising a filter located between the locking sleeve and the inner pipe.

7. The faucet body in accordance with claim 6, wherein the locking sleeve has an inside formed with a receiving space to receive the filter.

8. The faucet body in accordance with claim 1, wherein the water guide channel of the inner pipe extends longitudinally through a whole length of the inner pipe.

9. The faucet body in accordance with claim 1, wherein the inner pipe is fully hidden and encompassed by the outer pipe.

10. The faucet body in accordance with claim 1, wherein the outer pipe has a hollow inside enclosed around the outside of the inner pipe.

11. The faucet body in accordance with claim 5, wherein the threaded locking portion of the inner pipe is an outer threaded portion;

the threaded locking section of the locking sleeve is an inner threaded portion screwed onto the outer threaded portion of the threaded locking portion of the inner pipe.

* * * * *